US006132274A

United States Patent [19]

Nanami

[11] Patent Number: 6,132,274

[45] Date of Patent: Oct. 17, 2000

[54] WATERCRAFT ENGINE

[75] Inventor: Masayoshi Nanami, Iwata, Japan

[73] Assignee: Yamaha Hatsudoki Kabushiki Kaisha, Iwata, Japan

[21] Appl. No.: 09/277,833

[22] Filed: Mar. 26, 1999

[30] Foreign Application Priority Data

Mar. 27, 1998 [JP] Japan ..... 10-100425

[51] Int. Cl.[7] ..... B63H 21/36

[52] U.S. Cl. ..... 440/77; 114/55.5; 123/509

[58] Field of Search ..... 440/76, 77, 84; 114/55.5, 55.51, 55.53; 123/509

[56] References Cited

U.S. PATENT DOCUMENTS 5,309,885 5/1994 Rawlings et al. ..... 123/509

*Primary Examiner*—Jesus D. Sotelo

*Attorney, Agent, or Firm*—Knobbe, Martens, Olson & Bear LLP

[57] ABSTRACT

An engine arrangement for a personal watercraft having electrically operated fuel injectors. The cam cover of the cylinder head has a portion that extends in overlying relationship to the fuel injectors so as to protect the terminal ends thereof from water intrusion without inhibiting the accessibility of the fuel injectors for its servicing.

12 Claims, 4 Drawing Sheets

WATERCRAFT ENGINE

BACKGROUND OF THE INVENTION

This invention relates to a personal watercraft and more particularly to an improved engine construction suitable for use in such watercraft.

As is well known, personal watercraft are receiving large commercial interest and popularity. This type of watercraft is of a class that is designed generally to be operated by a single rider or operator who may carry no more than two or three additional passengers. These watercraft are quite sporting in nature and many times, the rider and passengers are clad in swimming garb.

Frequently, this type of watercraft is boarded while floating in the body of water from persons that are in the water. Because of its sporting nature, it is not unusual for this type of watercraft to occasionally capsize.

This presents a significant problem in that water can enter the watercraft hull during these operations and specifically the bilge area around the engine. This is a particular problem where the engine includes electrical components that have electrical connections which, if subjected to water, can short and/or become corroded.

Although the power plants for this type of watercraft were heretofore relatively simple, in the interest of environmental concerns, these engines are now becoming more complicated and using sophisticated electrical controls and features such as electronically controlled fuel injection.

The electrical connections for the fuel injectors are particularly critical because the fuel injectors generally are mounted in a fairly high area in the engine compartment and generally exposed so as to facilitate servicing. This means, however, that the electrical connections to the fuel injectors for their actuation can be subject to contact with water because of the aforenoted circumstances.

It is, therefore, a principle object of this invention to provide an improved watercraft engine wherein the construction of the engine itself protects components such as electronic components and electrical connections to fuel injectors to be protected from water intrusion.

It is a further object of this invention to provide an improved engine construction having an integral protective portion that protects electrical connections, specifically those associated with the fuel injectors.

It is a still further object of this invention to provide an improved cam cover arrangement for a watercraft engine.

SUMMARY OF THE INVENTION

This invention is adapted to be embodied in a personal watercraft having a hull defining a rider's area adapted to accommodate a rider operator and no more than two or three additional passengers. The hull further defines an engine compartment in which an internal combustion engine is provided. The engine is provided with at least one electronically operated fuel injector that it is mounted in an upper portion of the engine and which has a terminal portion that receives an electrical conductor for supplying control signals to the fuel injector. The engine has an engine cover which extends at least in part over the terminal portion of the fuel injector so as to direct down coming water away from the terminal connection.

DETAILED DESCRIPTION OF THE PREFERRED EMBODIMENT

Figure 1:
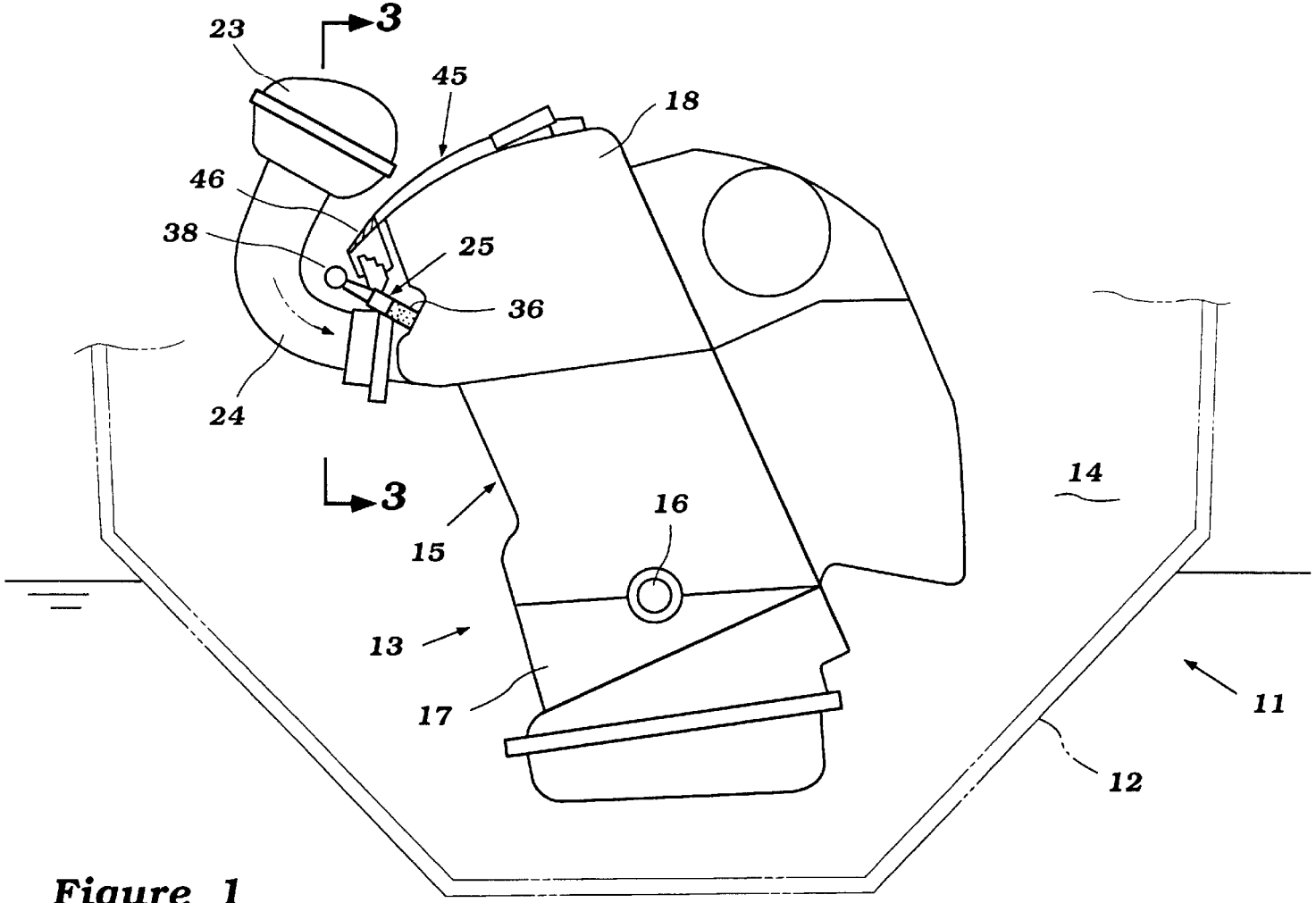
FIG. 1 is a partial cross-sectional view taken through a portion of the hull of a personal watercraft constructed in accordance with an embodiment of the invention, with the engine shown in part in solid lines and with a portion broken away and shown in section.

Referring now in detail to the drawings and initially primarily to FIG. 1, a personal watercraft constructed in accordance with an embodiment of the invention is shown primarily in phantom and is identified generally by the reference numeral 11. The watercraft 11 is comprised of a hull 12 which can have any suitable configuration and which forms a passenger's area (not shown) which would appear at the upper portion of this figure if it were illustrated.

This passenger's area is generally defined by a raised pedestal upon which a seat is positioned with foot areas disposed to the sides of this raised pedestal. This permits the rider or operator to be seated in a straddle fashion with one, two or three passengers seated behind the rider or operator in tandem fashion. The actual configuration of the passenger's area and the hull 12 may be of any type utilized in this art. However, for the reasons noted above, the invention has particular utility with the type of watercraft referred to as "personal watercraft".

An internal combustion engine, indicated generally by the reference numeral 13, is mounted within an engine compartment area 14 defined by the hull 12 and which may lie in substantial part below the raised pedestal and seat afore referred to. The engine 13 may be of any known type, but is, in accordance with a preferred form thereof, of the four cylinder in-line type.

To this end, the engine 13 is provided with a cylinder block 15 in which four aligned longitudinally spaced cylinder bores (not shown) are formed. In the illustrated embodiment, the cylinder block 15 is canted from a vertical position to an acute angle to one side, so as to more adequately utilize the space available and also to maintain a relatively lower center of gravity.

A crankshaft 16 is disposed at the lower end of the cylinder block 15 and is journaled within a crankcase chamber formed in part by a crankcase member 17 that is detachably connected to the cylinder block 15 in a manner well known in the art. A cylinder head assembly, indicated generally by the reference numeral 18, is affixed to the upper end of the cylinder block 15 in closing relationship to the cylinder bores formed therein.

As has been previously noted, the crankshaft 16 rotates about a longitudinally extending axis. This facilitates coupling to the impeller shaft 19 of a jet propulsion unit (not shown) that is mounted to the rear of the engine 13 within the hull 12 and specifically the underside thereof. A flexible coupling 21 is incorporated to provide this driving connection.

As is well known in this art, the jet propulsion unit (which is not shown) is mounted in the underside of the rear portion of the hull 12 and propels the watercraft 11 through the body of water in which it is operating by ingesting water through an inlet and discharging it rearwardly through a discharge nozzle. This type of arrangement is well known in the art.

Although the engine 13 may be of any known type, in the illustrated embodiment and in the preferred form thereof, the engine 13 is of the four cycle, overhead valve type and preferably has one or more overhead camshafts for directly actuating the intake and exhaust valves. The intake valves permit the flow of an intake charge into the combustion chambers of the engine from an air induction system, indicated generally by the reference numeral 22, and which is disposed at one side of the cylinder head 18.

This air induction system 22 includes an air inlet device 23 that draws atmospheric air admitted into the engine compartment 14 through a suitable ventilating system. This induction device 23 may also include a silencing arrangement.

The induction device 23 serves an intake manifold 24 that has a plurality of intake runners that mate with intake ports formed in one side of the cylinder head 18. It should be noted that the intake manifold 24 and specifically its runners extend outwardly to one side of the cylinder head 18 and then upwardly and in a reentrant formation so that the air inlet device 23 overlies the outlet end of the sections of the manifold 24 and fuel injectors, indicated generally by the reference numeral 25.

The fuel injectors 25 are provided for injecting fuel directly into either the intake passages of the engine if a manifold injection system is employed or directly into the combustion chambers if a direct injection system is employed.

Figure 2:
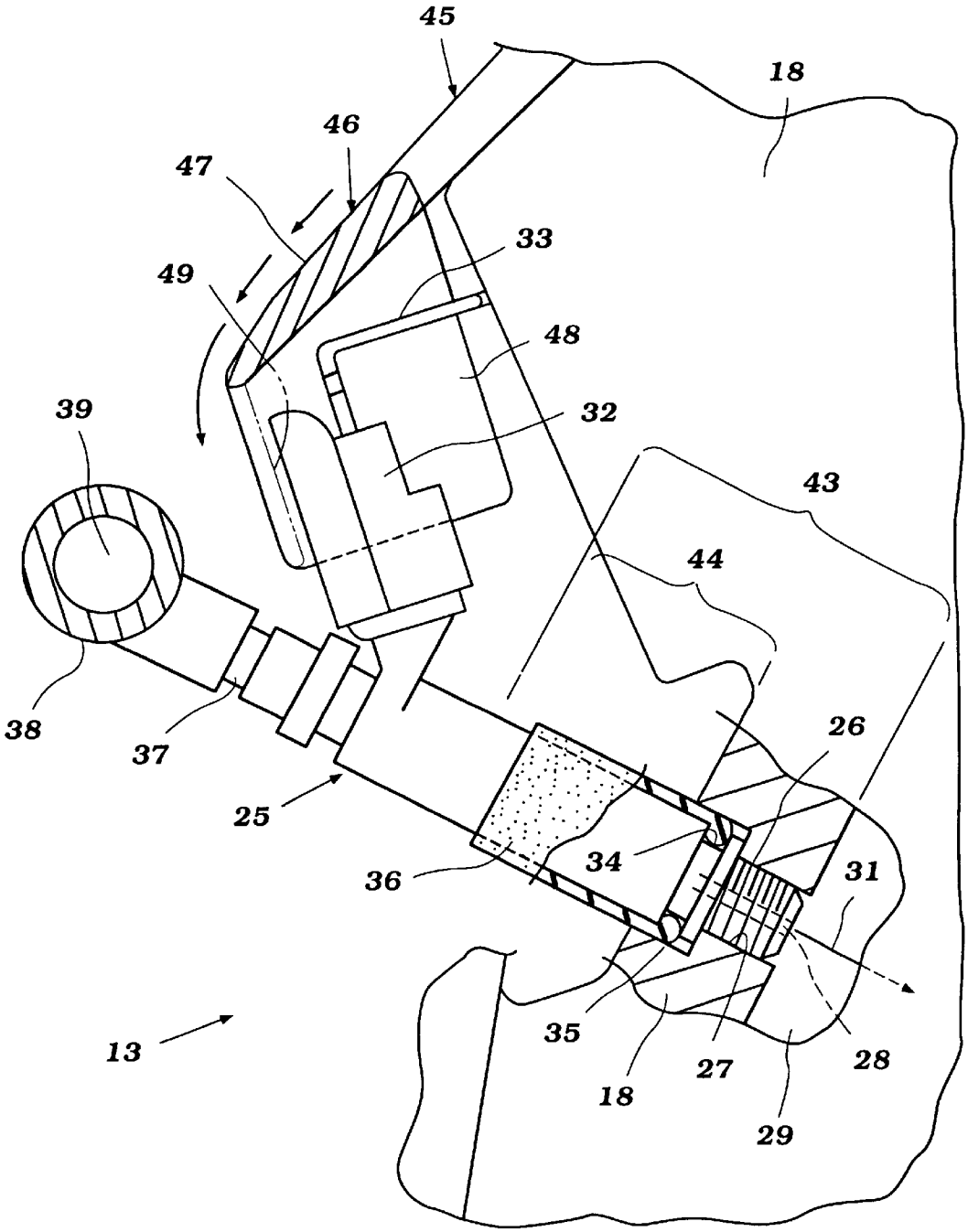
FIG. 2 is an enlarged view of the engine shown in FIG. 1 and particularly in the area of the broken away portion thereof, with still further parts of the engine being broken away.
Figure 3:
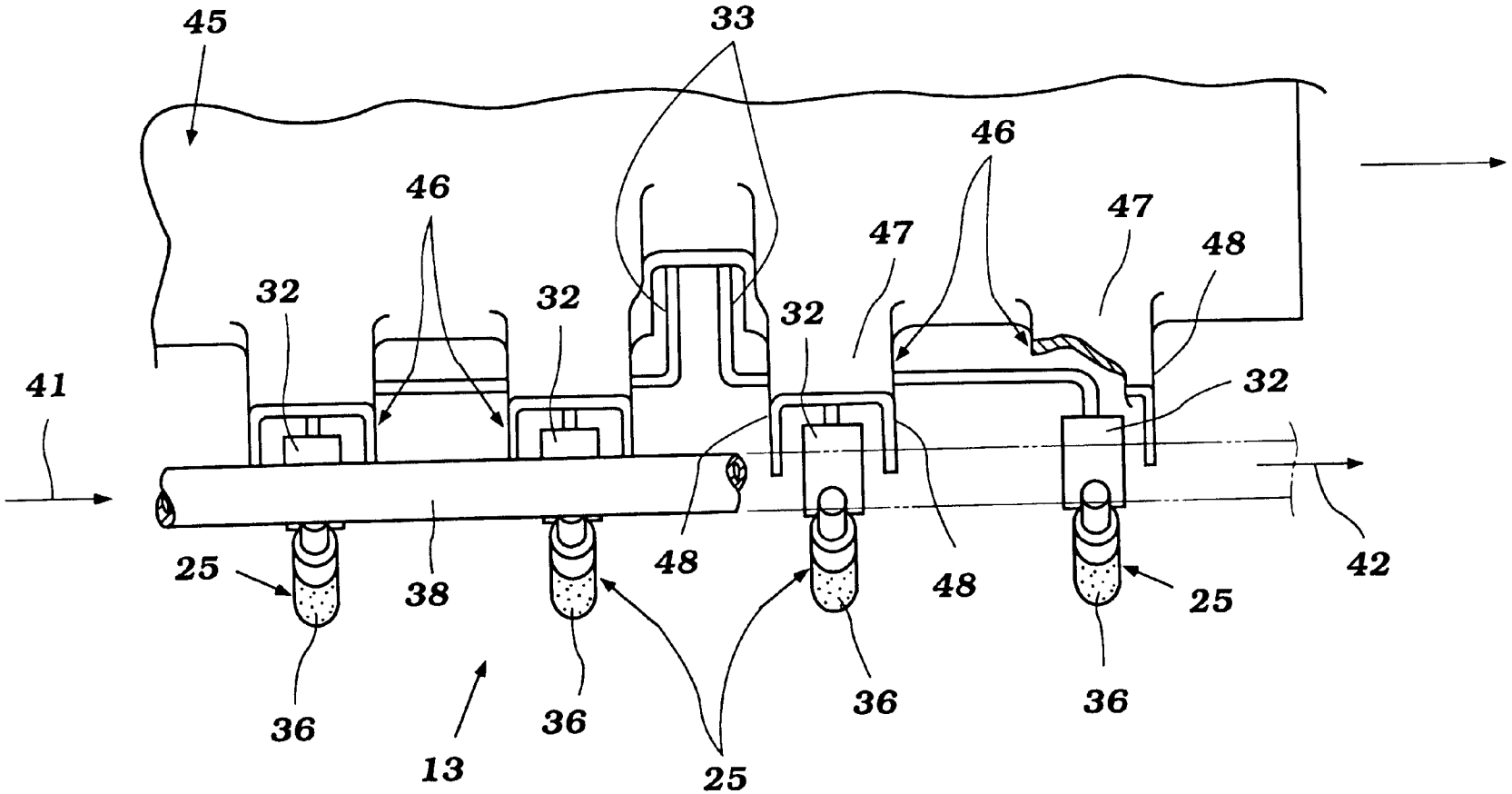
FIG. 3 is an enlarged cross-sectional view looking in the direction of the line 3—3 in FIG. 1.
Figure 4:
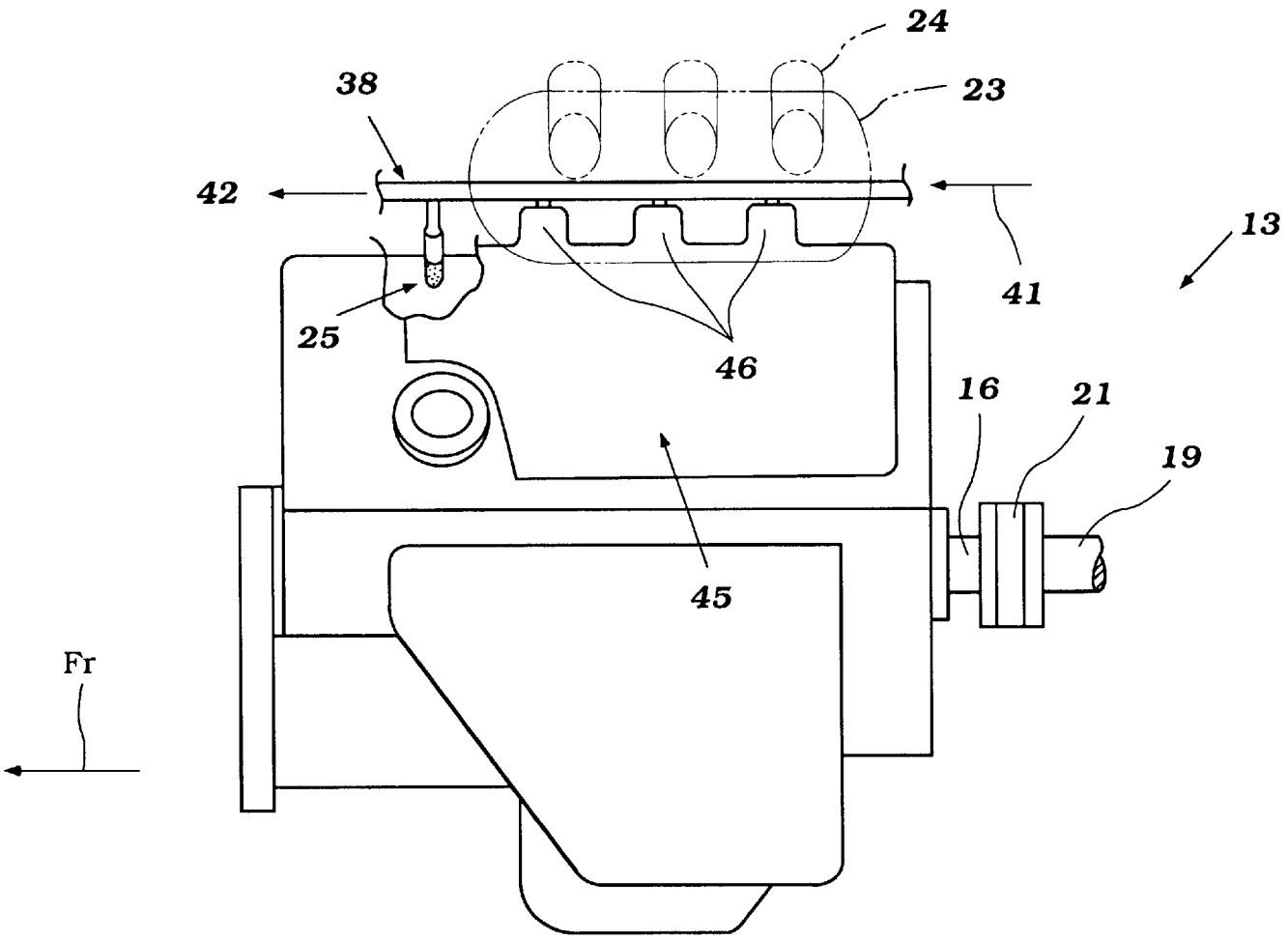
FIG. 4 is an enlarged side elevational view of the engine showing its mounting orientation in the watercraft hull and looking in the opposite direction from FIG. 4.

Referring now primarily to FIGS. 2 and 3, the fuel injectors 25 have threaded nozzle portions 26 that are tapped into threaded openings 27 formed in the cylinder head member 18 so as to spray through discharge nozzles 28 into the induction passages 29, assuming manifold injection is employed. The direction of fuel spray is indicated by the arrow 31 in FIG. 2.

Although the fuel injectors 25 may be of any known type, they incorporate an injector valve that controls the opening and closing of the injector port 28 and which is electrically actuated. A terminal portion 31 of the fuel injectors receives an electrical terminal 32 which is provided at the ends of conductors 33 so as to supply the electrical actuating signal to the fuel injectors 25. A suitable remotely positioned control may be incorporated so as to operate the injectors 25 in accordance with any desired or known control strategy.

The ends of the fuel injectors 25 adjacent their threaded nozzle portions 26 are provided with a circumferential groove 34 so as to receive a sealing o-ring like part 35 of an elastic grommet 36. The elastic grommet 36 encircles the lower part of the fuel injectors 25 and protects them.

Fuel is supplied to the fuel injectors 25 through fuel receiving portions 37 thereof from a main fuel rail 38. The main fuel rail 38 has an internal passage 39 to which fuel is delivered from a suitable fuel supply system. The direction of fuel delivery is indicated by the arrows 41.

As is typical in this art, a pressure regulator is provided that controls the maximum injection pressure by returning fuel back to the fuel source, in this case, from the front of the fuel rail 38 through a return path 42.

It will be seen from FIG. 2, that the injection nozzles 21 have an end portion 43, part of which is enclosed within the surrounding part of the cylinder head 18. The remaining part 44 is, for the most part, encircled and protected by the elastic boots 36. However, the electrical terminals 31 and their mating connectors 32 and the conduits 33 are exposed.

To protect these electrical components from water and potential corrosion, the cam cover 45 of the cylinder head assembly 18 is provided with extending shroud portions 46, each of which overlie these electrical components. In addition, the extending end parts 47 thereof are provided with downwardly extending flanges 48 and an outer wall 49 which encircle and encompass these electrical connections 31, 32 so as to protect them from water. Thus, any water which may come on top of the engine would be directed, as shown by the arrows in FIG. 2, away from the electrical connections.

In addition and as has been noted, the air inlet device 23 is also provided position above this area and offers further protection from intrusion by water.

Thus, this construction, however, leaves the injectors 27 generally exposed for servicing while still being protected. The terminals 32 can be pulled off because there is sufficient clearance by the extending portions 47 and the injectors can be removed for service if necessary without removing the cam cover.

Thus, from the foregoing description, it should be readily apparent that the engine construction is such that the fuel injectors and particularly their electrical connections are well protected from the elements and particularly water which may enter the engine compartment, but still are easily accessible for servicing. Of course, the foregoing description is that of a preferred embodiment of the invention, and various changes and modifications may be made without departing from the spirit and scope of the invention, as defined by the appended claims.

What is claimed is:

1. A personal watercraft engine arrangement comprised of a hull defining a rider's area for accommodating a rider operator and not more than three additional passengers, said hull defining an engine compartment containing an internal combustion engine for powering a propulsion device mounted within said hull for propelling said hull through a body of water, said engine having at least one electrically operated fuel injector positioned in an upper portion thereof, said engine having a cylinder head cover with an extending portion extending transversely outwardly in overlying relationship to a terminal end of said fuel injector for directing water away from said terminal end.

2. A personal watercraft engine arrangement as set forth in claim 1, wherein the projecting portion has depending side portions encircling the upper end of the fuel injector while permitting access thereto.

3. A personal watercraft engine arrangement as set forth in claim 1, wherein the engine is provided with a plurality of fuel injectors mounted in longitudinally spaced relationship to each other and wherein the engine cover has a projection extending over the terminal end of each of said fuel injectors.

4. A personal watercraft engine arrangement as set forth in claim 3, wherein the projecting portions for the fuel injectors are longitudinally spaced from each other.

5. A personal watercraft engine arrangement as set forth in claim 4, wherein each projecting portion has depending side portions encircling the upper end of the fuel injector while permitting access thereto.

6. A personal watercraft engine arrangement as set forth in claim 1, wherein the engine has a cylinder block that is inclined from the vertical and wherein the fuel injectors are mounted in a cylinder head that is affixed to the cylinder block and wherein the cylinder head cover comprises a cam cover for the cylinder head.

7. A personal watercraft engine arrangement as set forth in claim 6, wherein the projecting portion has depending side portions encircling the upper end of the fuel injector while permitting access thereto.

8. A personal watercraft engine arrangement as set forth in claim 6, wherein the engine is provided with a plurality of fuel injectors mounted in longitudinally spaced relationship to each other and wherein the engine cover has a projection extending over the terminal end of each of said fuel injectors.

9. A personal watercraft engine arrangement as set forth in claim 8, wherein the projecting portions for the fuel injectors are longitudinally spaced from each other.

10. A personal watercraft engine arrangement as set forth in claim 9, wherein each projecting portion has depending side portions encircling the upper end of the fuel injector while permitting access thereto.

11. A personal watercraft engine arrangement as set forth in claim 9, wherein the engine also has a manifold that overlies the projections.

12. A personal watercraft engine arrangement as set forth in claim 11 wherein the manifold comprises an intake manifold for supplying air for combustion in the engine.

* * * * *